US006475021B1

(12) United States Patent
Tan et al.

(10) Patent No.: US 6,475,021 B1
(45) Date of Patent: Nov. 5, 2002

(54) CONNECTOR HAVING A CABLE THAT IS RELATIVELY MOVEABLE ABOUT AN AXIS

(75) Inventors: Tang Yew Tan, Palo Alto; Richard P. Howarth, San Francisco; Lawrence A. Barham, San Jose; Gregory L. Tice, Los Altos; Steven G. Siefert, Belmont; Donald J. Novotney, Santa Clara, all of CA (US)

(73) Assignee: Apple Computer, Inc., Cupertino, CA (US)

( * ) Notice: Subject to any disclaimer, the term of this patent is extended or adjusted under 35 U.S.C. 154(b) by 69 days.

(21) Appl. No.: 09/752,249

(22) Filed: Dec. 27, 2000

Related U.S. Application Data

(63) Continuation-in-part of application No. 09/628,198, filed on Jul. 28, 2000, now Pat. No. 6,338,645.

(51) Int. Cl.[7] ..... H01R 13/56
(52) U.S. Cl. ..... 439/446; 174/13.1
(58) Field of Search ..... 439/446, 445, 439/447, 468, 777, 455, 731, 610, 31, 115, 467; 174/13.1

(56) References Cited

U.S. PATENT DOCUMENTS

| | | | | |
|---|---|---|---|---|
| 2,756,402 A | | 7/1956 | Haworth et al. | |
| RE32,760 E | | 10/1988 | Chandler et al. | |
| 5,138,678 A | | 8/1992 | Briggs et al. | |
| 5,324,209 A | | 6/1994 | Falossi et al. | |
| 5,707,252 A | * | 1/1998 | Meszaros | 439/108 |
| 6,203,377 B1 | * | 3/2001 | Grek et al. | 439/610 |
| 6,231,384 B1 | * | 5/2001 | Kuo | 439/545 |

* cited by examiner

*Primary Examiner*—Brian Sircus
*Assistant Examiner*—Phuong Dinh
(74) *Attorney, Agent, or Firm*—Blakely, Sokoloff, Taylor & Zafman LLP

(57) ABSTRACT

Cable assembly housing. The invention includes a cable assembly housing. The cable assembly housing may include a main shell that defines a first cavity. The main shell may have a collar. The cable assembly may also include a cable shell that defines a second cavity. The cable shell may have three necks, two of which are disposed inside the first cavity, and the third neck is extended outside the collar. The cable shell may rotate about an axis of the main shell such that the cable shell is set at a predetermined angle and position with respect to the main shell.

25 Claims, 13 Drawing Sheets

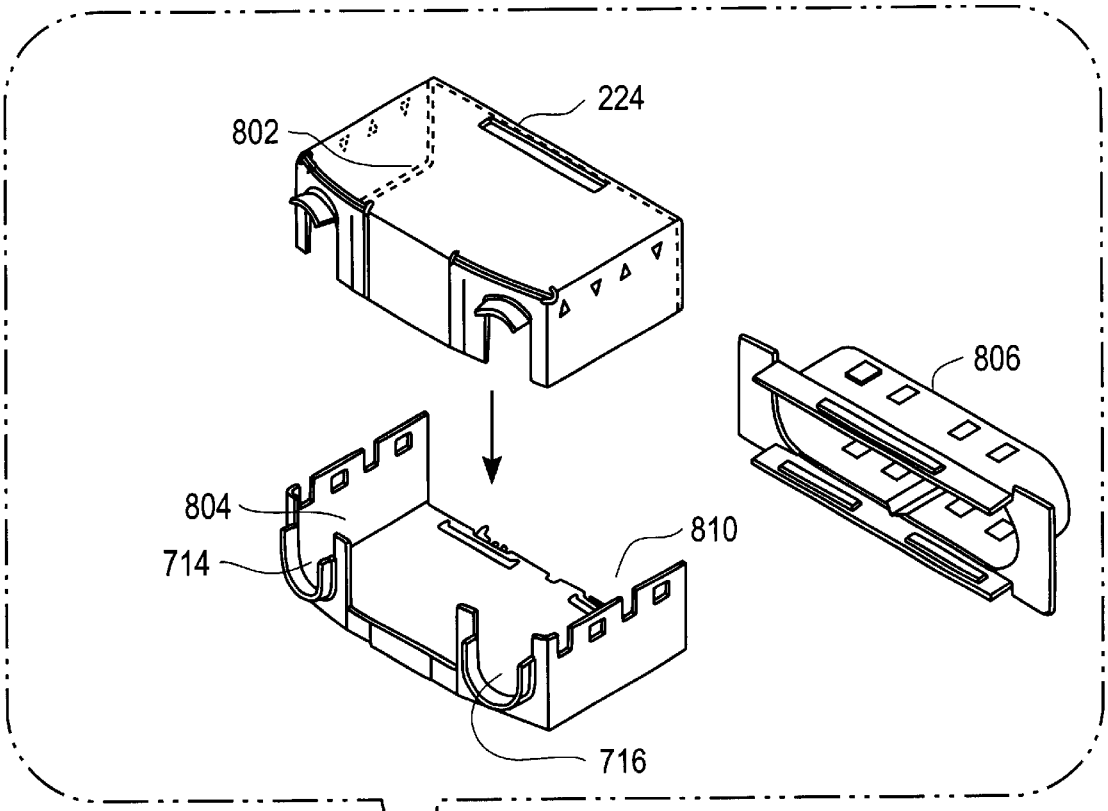
FIG. 8-1
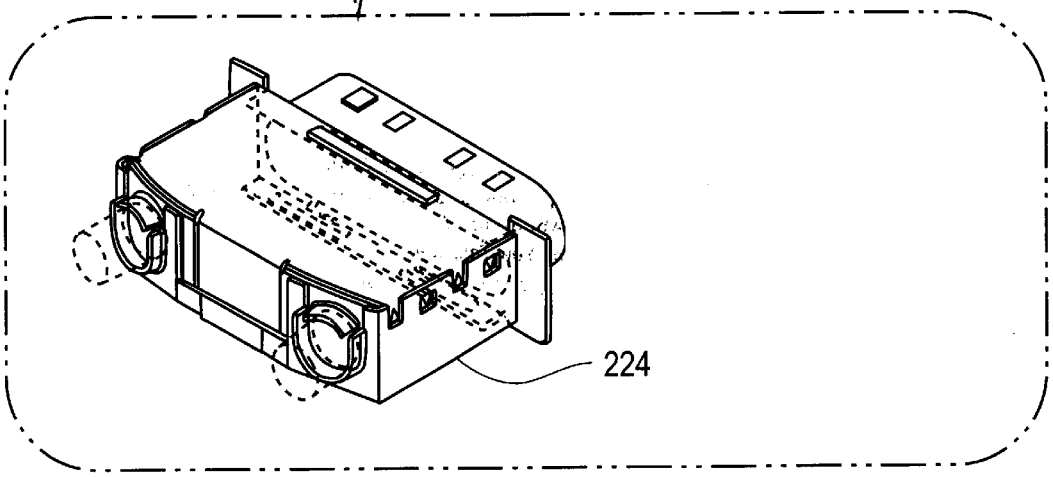
FIG. 8-2
FIG. 8

CONNECTOR HAVING A CABLE THAT IS RELATIVELY MOVEABLE ABOUT AN AXIS

REFERENCE TO RELATED APPLICATION

This is a continuation in part of application Ser. No. 09/628,198 filed on Jul. 28, 2000 now U.S. Pat. No. 6,338,645.

BACKGROUND OF THE INVENTION

The invention may include interrelated electrical connectors that are rotatable about an axis.

A personal computer system may be thought of as a general-purpose, single-user microcomputer that is designed to be operated by a person. A small and low cost personal computer (PC) may include a monitor connected to a computer, each of which may receive power from an ordinary outlet. In operation, the monitor accepts video signals from a graphic card within the computer over a cable assembly and displays this information on a screen.

A monitor generally is designed to sit on an ordinary office desk. In some office arrangements, the computer is disposed directly below the monitor wherein the computer itself resides on the office desk. Here, this low profile computer is referred to as a desktop computer that is part of a desktop personal computer system configuration and has a low profile. In another office arrangement, the computer stands upright on the floor with the cabling running to a monitor, where the monitor itself sits directly on the office desk. In this set up, the computer is referred to as a stand alone computer that is part of a stand alone personal computer system configuration.

In both the desktop configuration and the stand alone configuration, the cable assembly includes a cable that is attached to a connector. The connector is usually a fifteen to twenty four pin connector that is plugged into the graphic card.

SUMMARY OF THE INVENTION

The invention includes a cable assembly housing. The cable assembly housing may include a main shell that defines a first cavity. The main shell may have a collar. The cable assembly may also include a cable shell that defines a second cavity. The cable shell may have three necks, two of which are disposed inside the first cavity, and the third neck is extended outside the collar. The cable shell may rotate about an axis of the main shell such that the cable shell is set at a predetermined angle and position with respect to the main shell.

The invention also includes a cable assembly. The cable assembly may include a main shell that defines a first cavity. The main shell may have a collar. The cable assembly may also include a cable shell that defines a second cavity. The cable shell may have three necks, two of which are disposed inside the first cavity, and the third neck is extended outside the collar. The cable assembly may also include a plurality of wires disposed through the second cavity. The plurality of wires may be divided into two bundles. The cable assembly may also include an electromagnetic interference shield. The electromagnetic interference shield may have two back openings to accept two bundles of wires.

BRIEF DESCRIPTION OF DRAWINGS

FIGS. 8-1 and 8-2 illustrate an example of an electromagnetic interference shield having two back openings.

DETAILED DESCRIPTION OF THE INVENTION

Figure 1A:
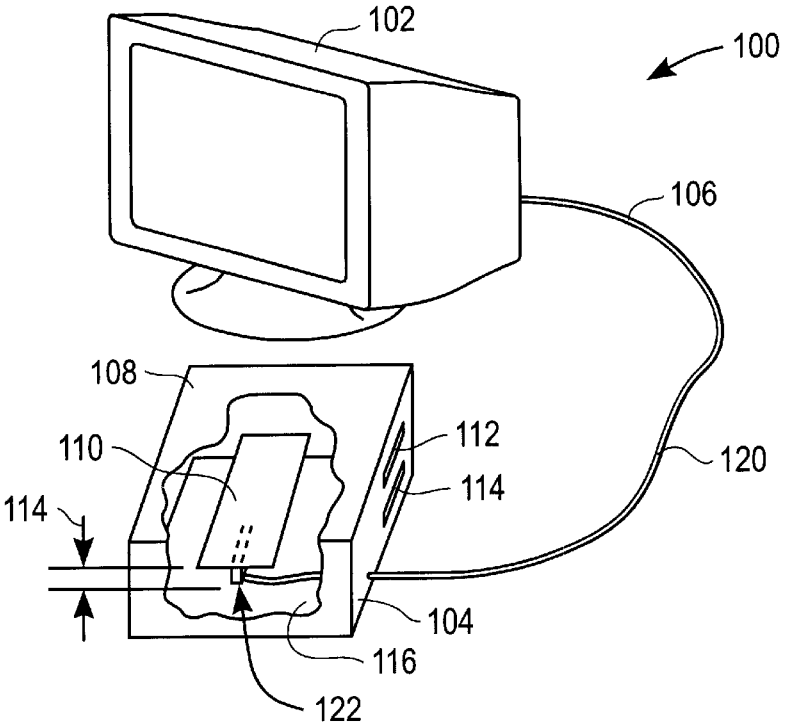
FIG. 1A illustrates an example of a personal computer system in a desktop configuration.

FIG. 1 illustrates a personal computer system 100 in a desktop configuration. A personal computer system 100 may include a monitor 102, a desktop computer 104, and a cable assembly 106. Monitor 102 may be a cathode-ray tube and associated electronics connected to a video output of desktop computer 104, or it may be a flat panel display such as a liquid crystal display. Desktop computer 104 may be any machine that can be programmed to manipulate symbols.

Desktop computer 104 may include a chassis 108 having a graphics card 110, which is disposed therein. Chassis 108 may also have a Small Computer System Interface (SCSI) slot 112, a Peripheral Component Interconnect (PCI) slot 114 located as shown in FIG. 1, and/or it may have a Universal Serial Bus (USB), and/or "Firewire" interfaces (which are based on IEEE 1394). Each of the SCSI slot 112 and PCI slot 114 and/or USB and Firewire interfaces may provide an input/output port for connection of external devices.

Graphics card 110 may be a circuit board fitted within chassis 108 that contains the necessary video memory and other electronics to provide a bitmap display. Graphics card 110 may have an output port (not shown) that faces the bottom surface 116 of chassis 108. Distance 118 between the output port of the graphics card 110 and the bottom surface 116 may be a low profile distance, such as 60.0 millimeters (mm) or 2.4 inches.

A cable assembly 106 may include a cable 120 and a connector 122. Cable 120 may be a bound or sheathed group of mutually insulated conductors. Monitor 102 may be attached at one end of cable 120, and connector 122 may be attached to a port of a graphics card.

Connector 122 may be any pin to socket connector or other types of connection mechanisms. At the open mating end:of connector 122, connector 122 may be attached to graphics card 110 as shown in FIG. 1A. As a result of the low profile stretch of distance 118, connector 122 may be required to be at an angle with respect to an axis of cable 120 where the angle formed is less than one hundred-eighty (180) degrees, for example ninety degrees.

Figure 1B:
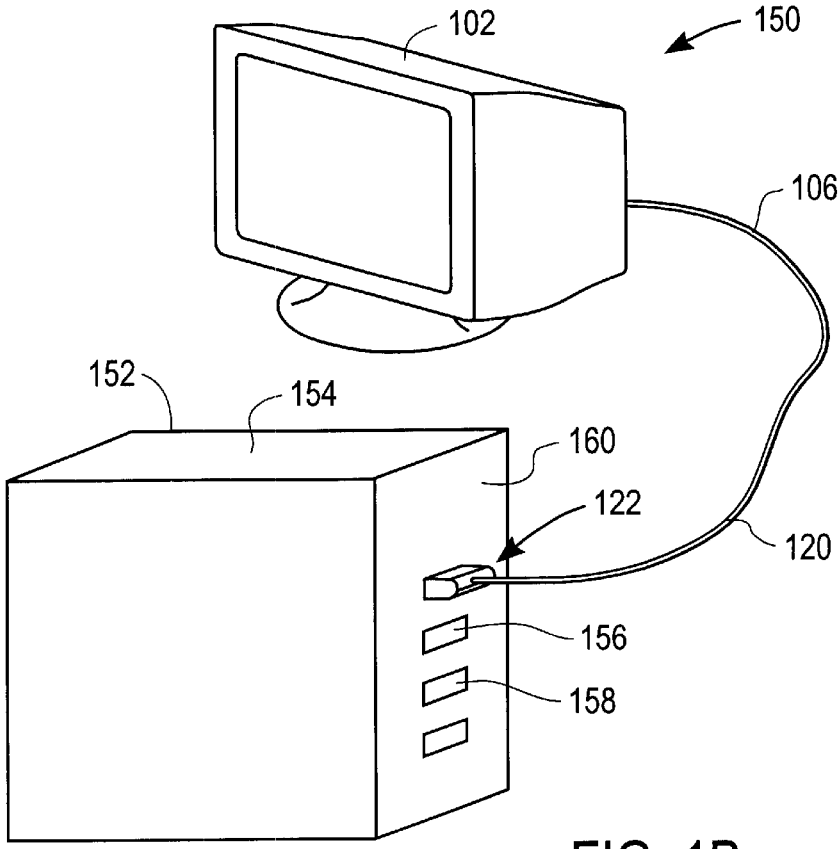
FIG. 1B illustrates an example of a personal computer system in a stand alone configuration.

FIG. 1B illustrates a personal computer system 150 in a stand alone configuration. A personal computer system 150 may include a monitor 102, a stand alone computer 152, and a cable assembly 106. Stand alone computer 152 may include a chassis 154 having a SCSI slot 156 and a PCI slot 158 disposed and/or USB or Firewire interfaces near a video port 160. A video port 160 may be attached to a graphics card 110 (not shown in FIG. 1B).

Connector 122 may be attached to video port 160 at the open mating end of connector 122. To avoid interference with other ports, by a cable 120, connector 122 may be required to be at an angle with respect to an axis of the cable 120. Here, in the system shown in FIG. 1B where there is sufficient space, cable 120 may be viewed as being dressed straight out from connector 122 where the angle formed between cable 120 and connector 122 is one hundred-eighty (180) degrees.

Figure 2A:
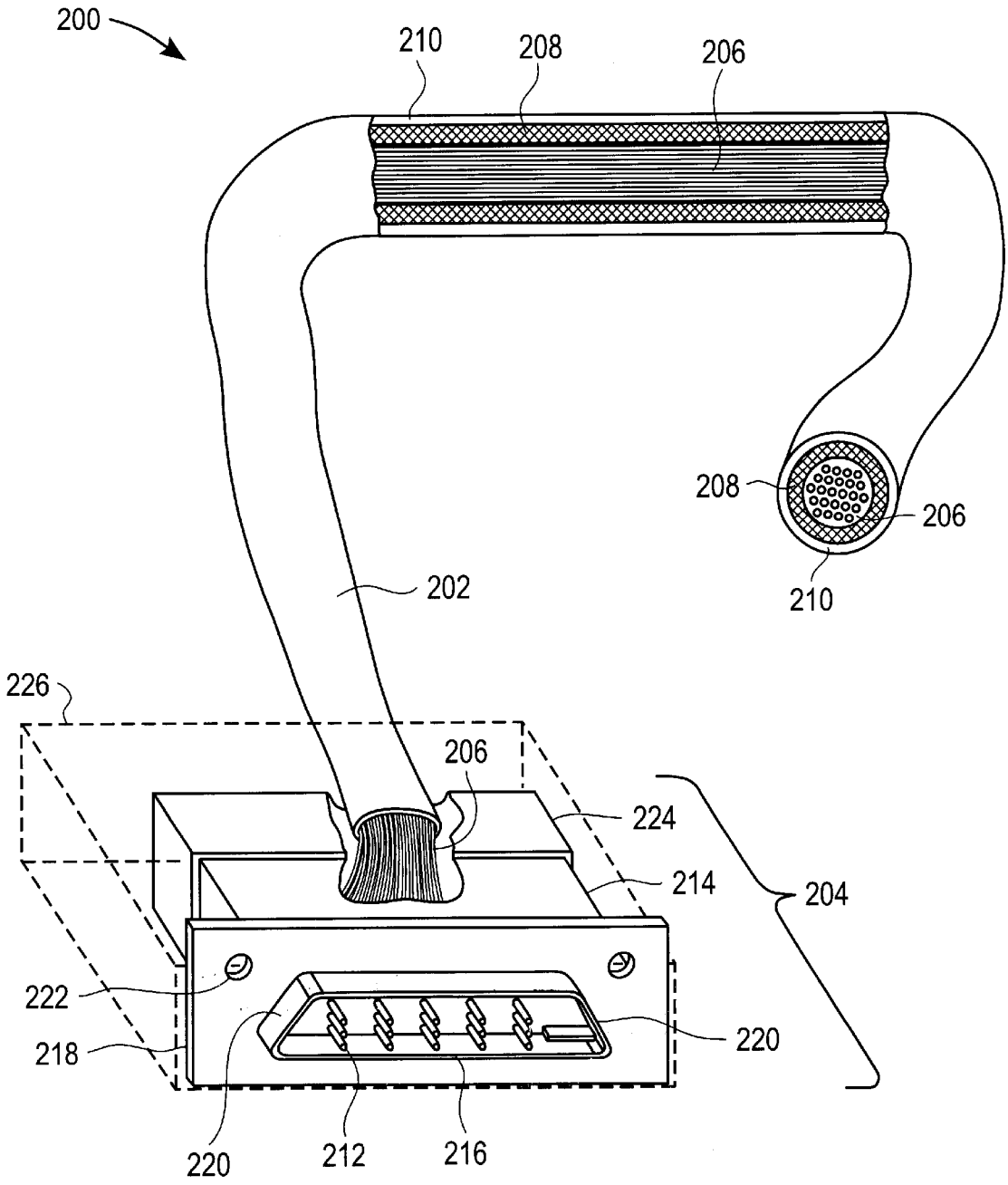
FIG. 2A illustrates an example of a Plug and Display cable assembly.
Figure 2B:
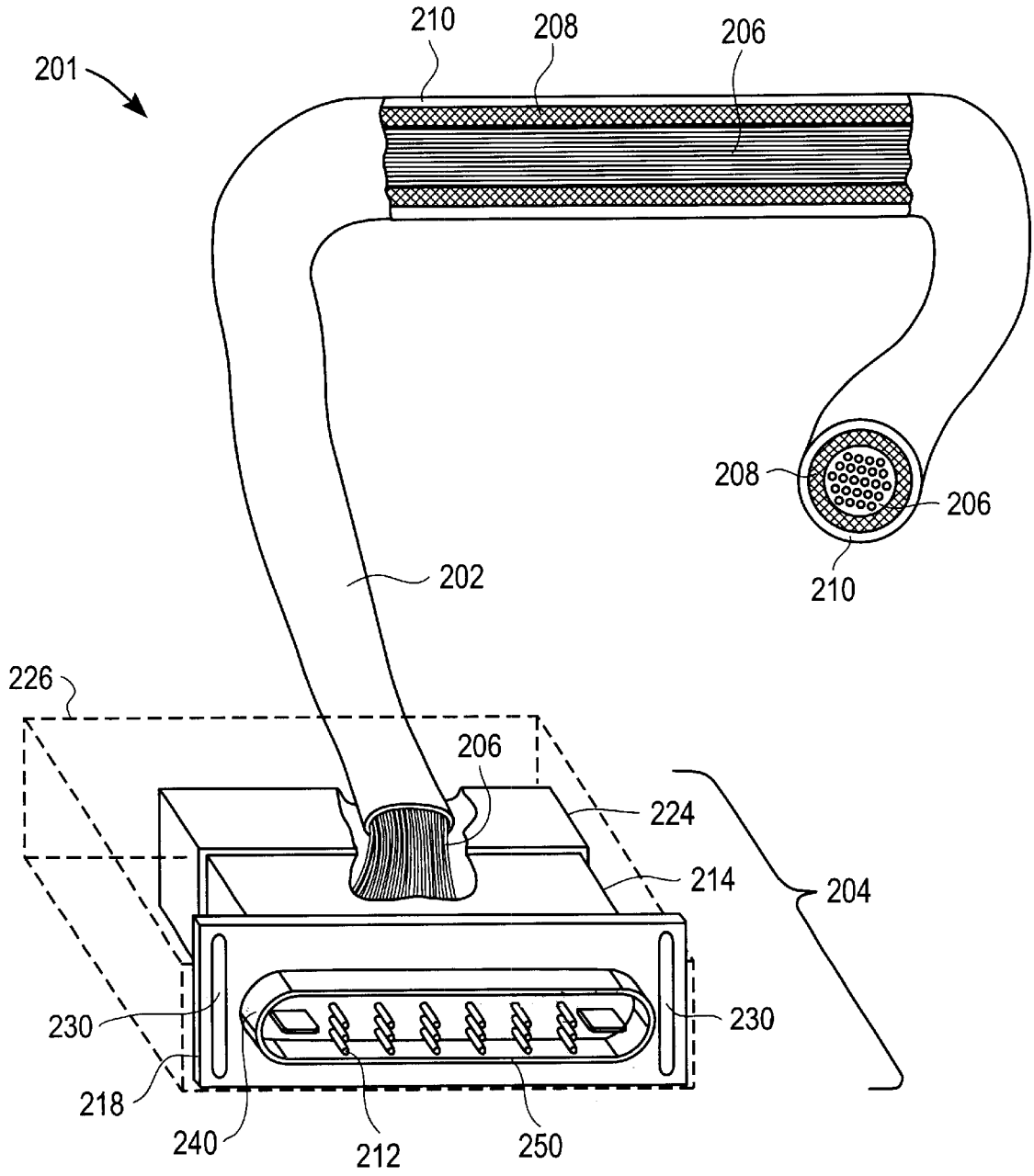
FIG. 2B illustrates an example of an improved cable assembly.

FIGS. 2A and 2B illustrate a cable assembly 200 and a cable assembly 201 respectively. Cable assembly 106 of FIG. 1A and FIG. 1B may be based on cable assembly 200 or cable assembly 201. Cable assembly 200 may be thought of as a Plug and Display cable assembly and cable assembly 201 may be thought of an improved or modified Plug and Display cable assembly. A cable assembly 200 and a cable assembly 201 are similar except for the differences highlighted below.

Cable assembly 200 and a cable assembly 201 may include a cable 202 and a connector 204. Cable 202 may include a plurality of wires 206, shield 208, and jacket 210. Each of the wires 206 may be a metallic strand or rod that is electrically insulated so as to safely and separately conduct electricity. Although there may be any number of wires 206, in one embodiment, the number of wires 206 ranges from seventeen to twenty four.

Electricity traveling through each wire 206 may generate an electromagnetic field. Where not curbed, this electromagnetic field may interfere with video images, such as those appearing on a monitor 102 of FIG. 1A. In one embodiment, a shield 208 may be disposed about wires 206. Shield 208 may be metallic strand that are braided into a tube shape so as to confine any electromagnetic field generated by wire 206 within the interior of shield 208. Shield 208 may also serve as a ground conductor. Moreover, jacket 210 may be disposed about a shield 208 as an insulator.

Connector 204 may include posts 212, cover 214, connector shell 216, and flange 218. Posts 212 may provide an electrical pathway between wires 206 and, for example, a graphics card 110 of FIG. 1A. Posts 212 may either be male or female pins that are supported by flange 218. Each wire 206 may be connected to an assigned post 212 within a cover 214. Cover 214 may serve to enclose wires 206 as well as the connection point between wires 206 and posts 212.

In one embodiment, (FIG. 2A), connector shell 216 may enclose the mating end of post 212, include keys 220 and be mounted against flange 218. Along with keys 220, the asymmetrical shape of connector shell 216 may provide orientation and insertion guidance for connector 204 with respect to graphics card 110. Where flange 218 includes mounting holes 222, screws may be disposed through the mounting holes 222 and into chassis 154 or graphics card 110 so as to secure connector 204 to a structure.

In another embodiment, (FIG. 2B), connector shell 216 replaces connector shell 240. Connector shell 216 may include notch 250. Connector shell 240 may enclose the mating end of posts 212, and be mounted against flange 218. Since shell 240 is symmetrical otherwise (without notch 250), notch 250 may provide orientation and insertion guidance for connector 204 with respect to graphics card 110. Instead of including mounting holes 222, flange 218 includes slits 230. Instead of including screws, connector 204 includes quicklatches (not shown in FIG. 2B, details to be followed below). Quicklatches may be disposed through slits 230 and into chassis 154 or graphics card 110 so as to secure connector 204 to a structure.

Where wires 206 exit from a jacket 210 and enter a cover 214, the electromagnetic field caused from these wires 206 may be free to interfere with local electronics. To prevent this, connector 204 may further include an Electromagnetic Interference (EMI) shield 224. As a metal structure, an EMI shield 224 may provide a seal between jacket 210 and the EMI shield 224.

Housing 226 may be disposed about connector 204 and portions of cable 202. Housing 226 and connector 204 are discussed in connection with the remainder of the figures. Connector 204 and cable 202 may be thought of as interrelated electrical connectors. In this sense, housing 226 may permit relatively movement between a connector 204 and cable 202 so that a cable assembly, such as a cable assembly 200 and cable assembly 201 may serve as a cable assembly 106 of FIGS. 1A and FIG. 1B.

According to this invention, an articulating connector is a cable assembly that is capable of rotational movement. To achieve this feature, cable 202 may be housed in the housing 300 (see discussion below). Housing 300 may enable dressing of a cable at more than one angle, for examples, at one hundred-eighty-degrees and ninety-degrees. One advantage of having an articulating connector is that different computer systems have different space and connection constraints that determine the dressing requirements of the cable. The articulating connector meets various dressing requirements.

Figure 3:
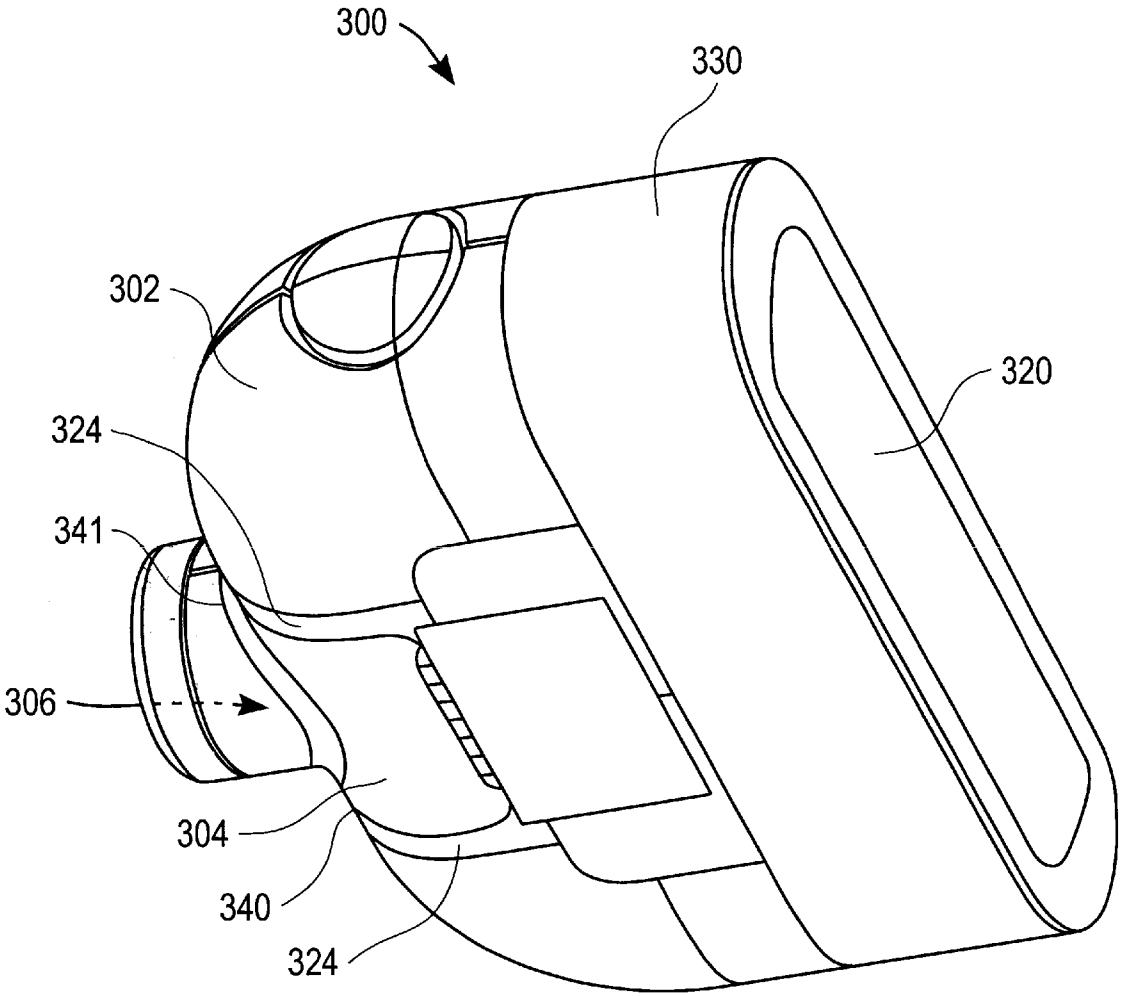
FIG. 3 illustrates an example of an enlarged view of a cable housing.

FIG. 3 illustrates one embodiment of the invention, housing 300. Housing 300 may include a main shell 302 and a cable shell 304. Main shell 302 may have the interior material removed to form a first cavity 320. Cable shell 304 may also have the interior material removed to form a. second cavity 306. In one embodiment, main shell 302 is formed in a single piece having a collar 324. It is through collar 324 that cable shell 304 is disposed. Cable shell 304 may be a T-shaped joint comprising three necks (not shown in FIG. 3A) and when cable shell 304 is disposed within main shell 302, only one neck extends outside main shell 302. Cable shell 304 may rotate about an axis of main shell to provide cable dressing in different angles and positions. It will be appreciated that this articulating connector may be used for various types of computer interfaces, including video interfaces, USB interfaces, Firewire interfaces, and Peripheral Component Interconnect (PCI) interfaces, etc.

Figure 4A:
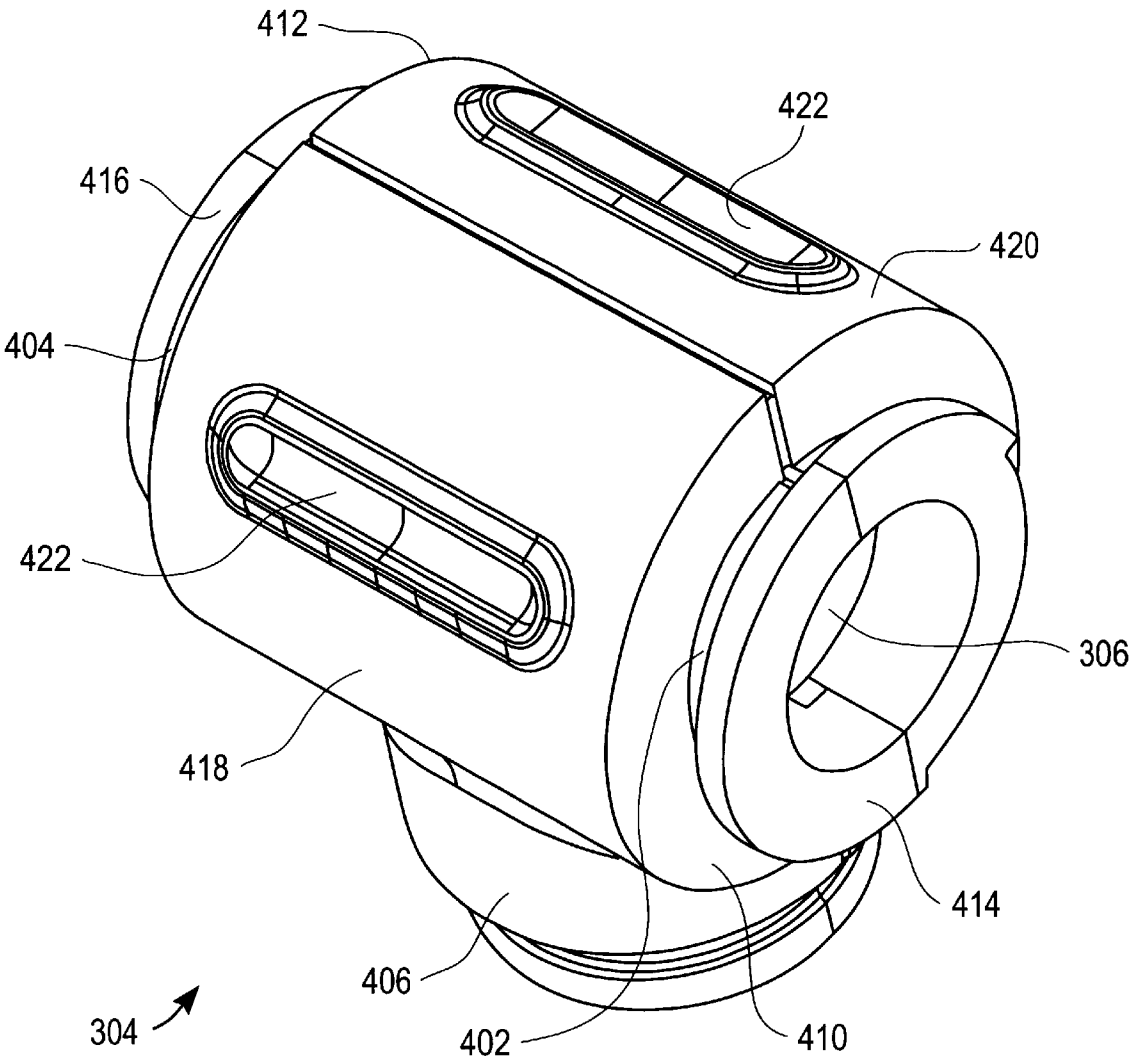
FIG. 4A illustrates an example of an enlarged view of a cable shell housing.

FIG. 4A illustrates that cable shell 304 may also include top cable shell piece 418 which is coupled to bottom cable shell piece 420. Cable shell 304 may also include mating surfaces 410 and 412, necks 402, 404, and 406, flanges 414 and 416, and slots 422.

As mentioned above, cable shell 304 may have the interior material removed to form second cavity 306. Second cavity 306 may be a hollow area within the body of cable shell 304 that permits wires, such as those of cable 202 (FIGS. 2A–B), to be disposed within and through cable shell 304. Cavity 306 may have a circular or cylindrical perimeter. In one embodiment, each of necks 402, 404 and 406 includes a circular perimeter.

As mentioned above, cable shell 304 may be a T-shaped joint including three necks; they are: a first neck 402, a second neck 404 and a third neck 406 as illustrated in FIG. 4A. When cable shell 304 is disposed within main shell 302, first neck 402 and second neck 404 are the ones being disposed through collar 324. Neck 406 extends outside collar 324 and it is through neck 406 that a cable such as cable 202 of FIGS. 2A–B, will first be inserted into housing 300.

In a preferred embodiment, first neck 402 is disposed between first mating surface 410 and first flange 414. Similarly, second neck 404 is disposed between second mating surface 412 and second flange 416. (See FIG. 4). Each of mating surfaces 410 and 412 may be the outer or topmost boundary of each side arm of cable shell 304 where necks 402 and 404 are located. Each mating surface serves as one of a matched pair of surfaces that comes together at interface 340 and 341 depicted in FIG. 3. Each of necks 402 and 404 may be a narrow ring that elevates a flange, either flange 414 or flange 416, above a mating surface so as to form a protruding rim. With its protruding and tapered rim, flange 414 and flange 416 may be used to hold cable shell 304 against main shell 302 as well as provide clearance for wires 206.

Figure 4B:
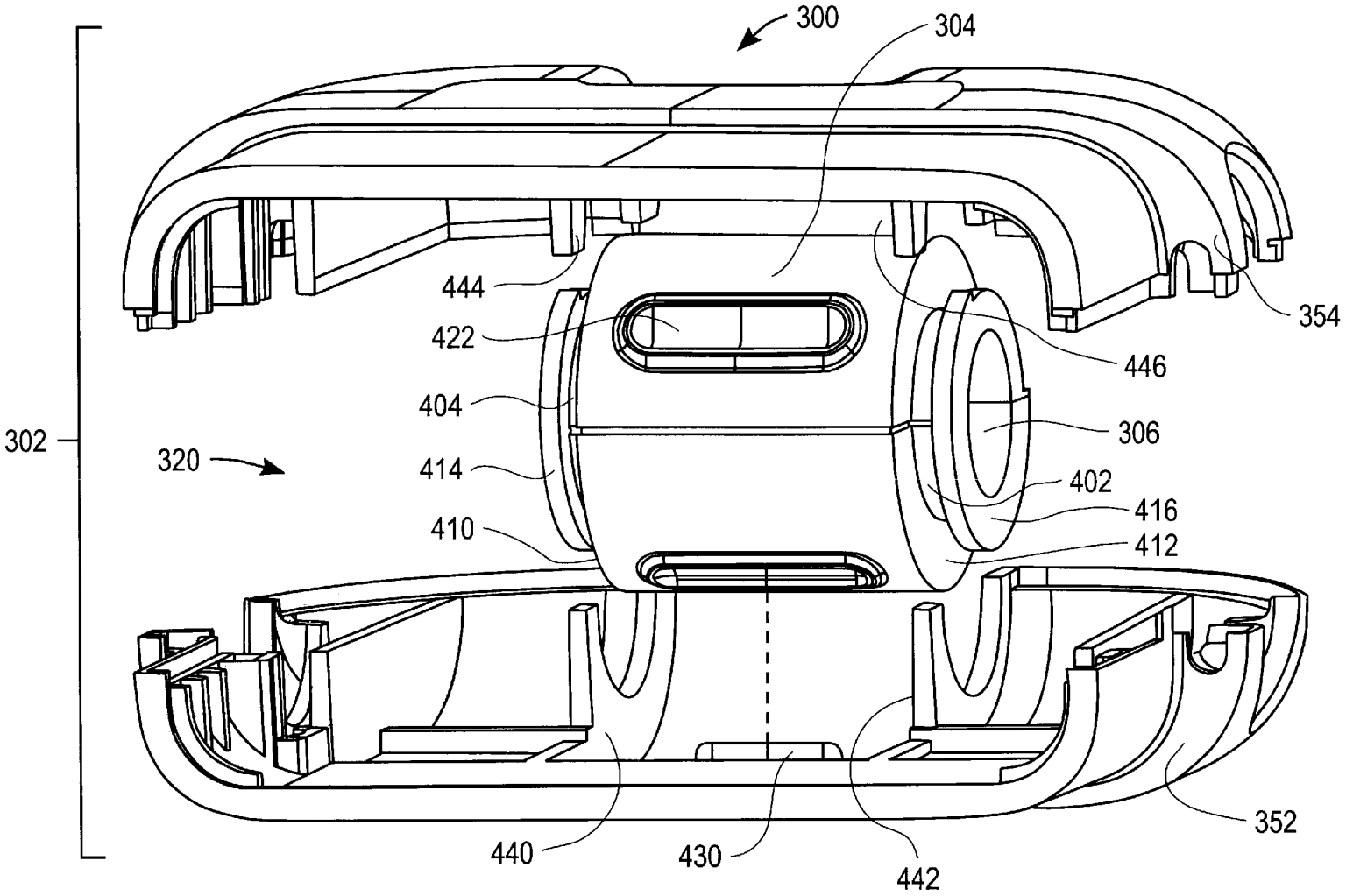
FIG. 4B illustrates an example of an exploded view of a cable shell disposed inside a main shell.

FIG. 4B illustrates that in one embodiment, neck 402 and neck 404 are disposed inside main shell 302 such that cable shell 304 can rotate about an axis of main shell 302. It may be desirable to control or limit the rotation of cable shell 304 as it rotates about an axis of main shell 302. Thus, cable shell 304 may be designed so as to allow the cable shell 304 to rotate to a predetermined angle and then lock into main shell 302. To achieve this, cable shell 304 is designed with at least one slot 422. Slot 422 is defined into an outer surface of cable shell 304 and extending axially along this outer surface. Each slot 422 may serve as a stop that limits or locks the rotational movement of cable shell 304 relative to main shell 302.

In another embodiment, cable shell 304 is designed with two of slots 422. In this example, cable shell 304 may rotate and lock into two different positions and angles. For example, one slot 422 may be located at a ninety-degree angle to another slot 422. In that design, cable shell 304 can be rotated and then locked into either a one hundred-eighty or a ninety-degree angle relative to main shell 302. (See FIG. 4C and 4D respectively). A button on the main shell 302 may be depressed to release the lock and allow cable shell 304 to rotate between these angular positions.

FIG. 4B also illustrates that in a preferred embodiment, main shell 302 includes a first main shell piece 352 which can be coupled to a second main shell piece 354. A crystal cap 330 depicted in FIG. 3 may be disposed over first and second main shell pieces 352 and 354 so as to secure the coupling of the first and second main shell pieces. (See FIG. 3).

FIG. 4B also shows that in one embodiment, first main shell piece may include a detent 430 protruding out from the edge of collar 324. Detent 340 may be a pawl or a hinge that engages slot 422 so as to facilitate the locking or limitation of the rotational movement of cable shell 304 about an axis of main shell 302. Detent 340 may have thickness and dimension such that it enables sufficient locking or limiting while still facilitating easy release of cable shell. Where cable shell 304 is coupled to main shell 302, detent 430 may engage slot 422 to provide a limit on the rotation between cable shell 304 and main shell 302. With detent 430, cable shell 304 may rotate about an axis of main shell 302 and lock into a position along the axis to form a predetermined angle, such as one hundred-eighty or ninety-degree, with main shell 302.

As mentioned above, main shell 302 may have interior material removed to form first cavity 320. Cavity 320 may be a hollow area within the body of main shell 302 that permits wires and a connector, such as those of cable 202 (FIGS. 2A–B), to be disposed at least one of within and through main shell 304. Cavity 320 may have a perimeter of any suitable shape, for example, circular, oblong, square, rectangular or oval.

FIG. 4B illustrates that in one embodiment, collar 324 may include mating surfaces 440 and 442 on first main shell piece 352 and mating surfaces 444 and 446 on second main shell piece 354. Mating surfaces 440 and 444 may be the outer or topmost boundary of one side of collar 324 that serves as the one of the matched pair of surfaces that comes together at interface 340 in FIG. 3A. And, mating surfaces 442 and 446 may likewise be the outer or topmost boundary of another side of collar 324 that serves as the one of the matched pair of surfaces that comes together at interface 341. Collar 324 may be an inwardly extending ring that forms an open space having a perimeter that is large enough to surround cable shell at neck 402 and 404 while leaving neck 406 extending outward from main shell 302.

Figure 5:
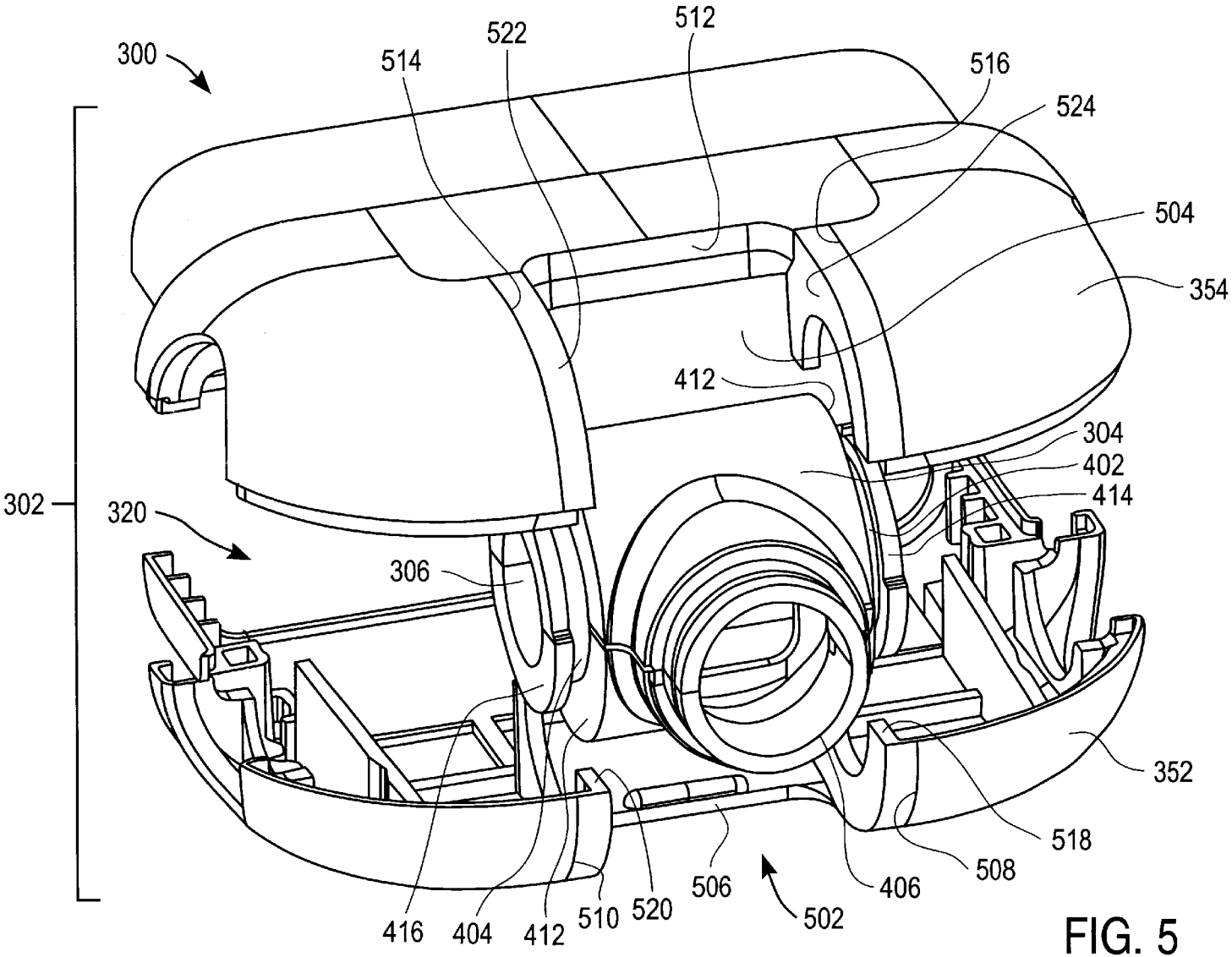
FIG. 5 illustrates an example of an exploded view of a cable shell disposed inside a main shell.

FIG. 5 illustrates that in an alternative embodiment, first main shell piece 352 may include first orifice 502 and that second main shell piece 354 may include second orifice 504. In this embodiment, collar 304 is formed when first main shell piece 352 and second main shell piece 354 are coupled together allowing orifice 502 and orifice 504 to unite thereby forming the collar 324.

FIG. 5 also illustrates that each of orifices 502 and 504 may also include three edges creating a U-shaped orifice in which two of the edges are running parallel to each other. For example, as illustrated in FIG. 5, orifice 502 includes edges 506, 508 and 510 in which edges 508 and 510 are running parallel to each other. Similarly, orifice 504 includes edges 512, 514 and 516 in which edges 514 and 516 are running parallel to each other. In one embodiment, edge 508 unites with edge 516 to form a mating surface that serves as a match for first mating surface 410. Similarly, edge 510 unites with edge 514 to form a mating surface that serves as a match for second mating surface 412. When all the mating surfaces mate, cable shell 304 is disposed within main shell 302 at interfaces 340 and 341. (See also FIGS. 3A and 4B).

In another embodiment, a boss is coupled to each of the parallel edges. For example, boss 518 is coupled to edge 508, boss 520 is coupled to edge 510, boss 522 is coupled to edge 514 and boss 524 is coupled to edge 516. Four Bosses 518, 520, 522 and 524 function to support cable shell 304 at necks 402 and 404 and allowing cable shell 304 to rotate smoothly within main shell 302. In this embodiment, the four bosses also act as the mating surfaces that match up with mating surfaces 410 and 412.

Figure 6:
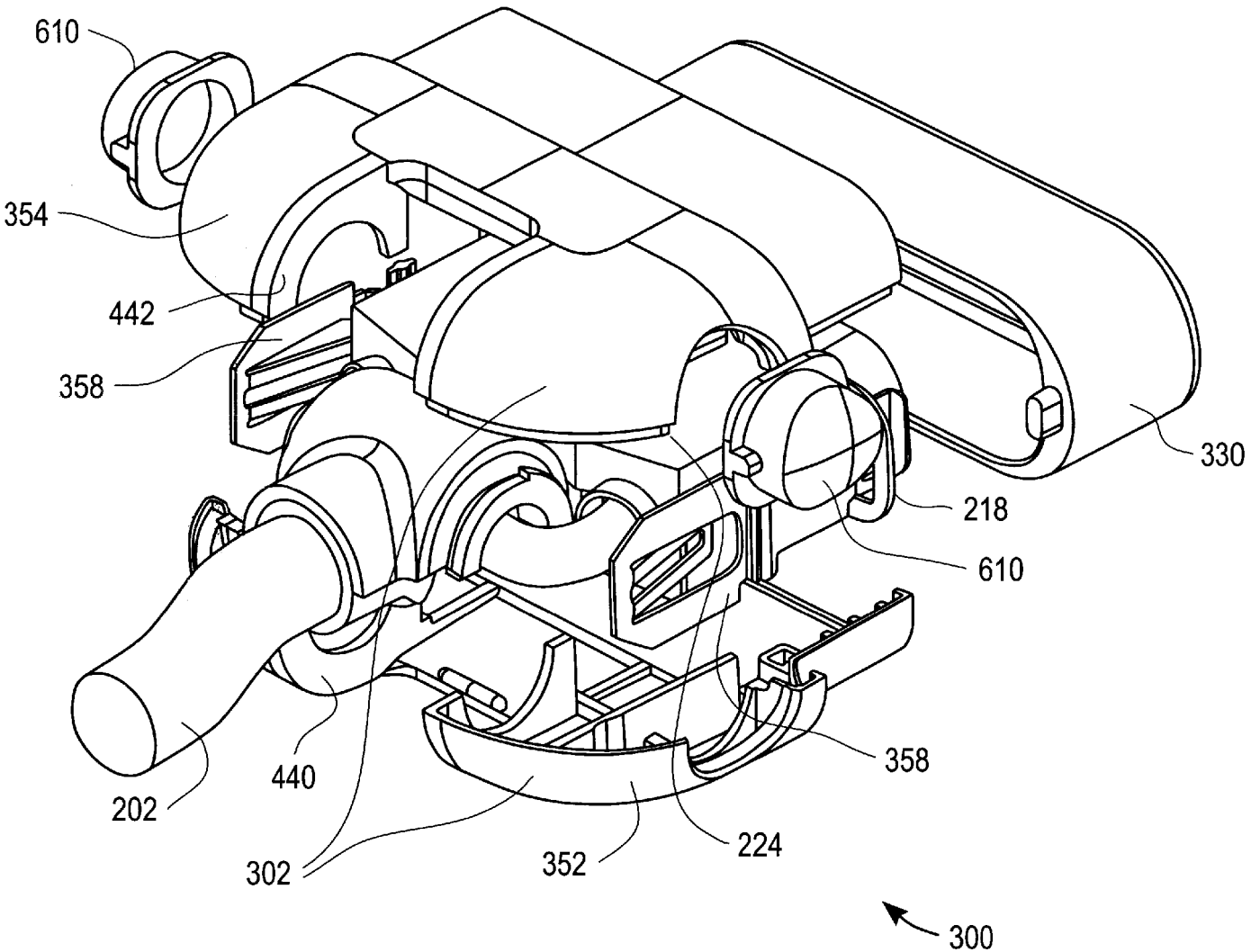
FIG. 6 illustrates and example of a cable assembly.

FIGS. 4B and 6 illustrate that to assemble housing 300, first main shell piece 352 may be brought into contact with second main shell piece 354 with flanges 414 and 416 disposed within first cavity 320. First main shell piece 352 then may be secured to second main shell piece 354 by employing methods such as sonic welding, or by applying adhesives. A crystal cap 330 may then be disposed over the first main shell piece 352 and the second main shell piece 354 securing the coupling of these two pieces. With main shell 302 formed, mating surfaces 440 and 444 may meet mating surface 410 and mating surfaces 442 and 446 may meet mating surface 412 of cable shell 304 as depicted in FIG. 4B.

Figure 4C:
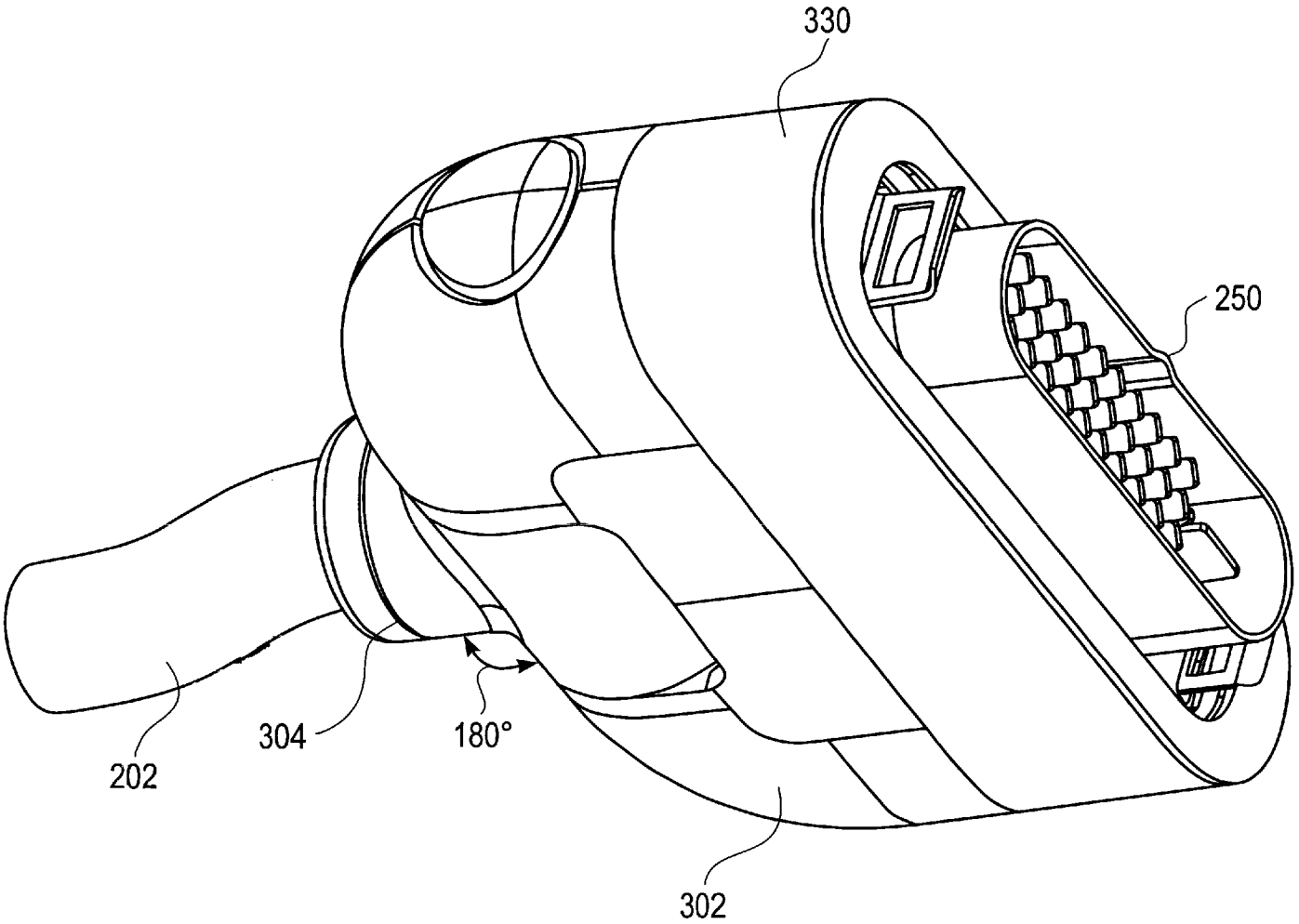
FIG. 4C illustrates an example of a main shell at one-hundred-eighty-degree angle orientation to a cable shell which may be an orientation suitable in a connection environment having sufficient space for this orientation.
Figure 4D:
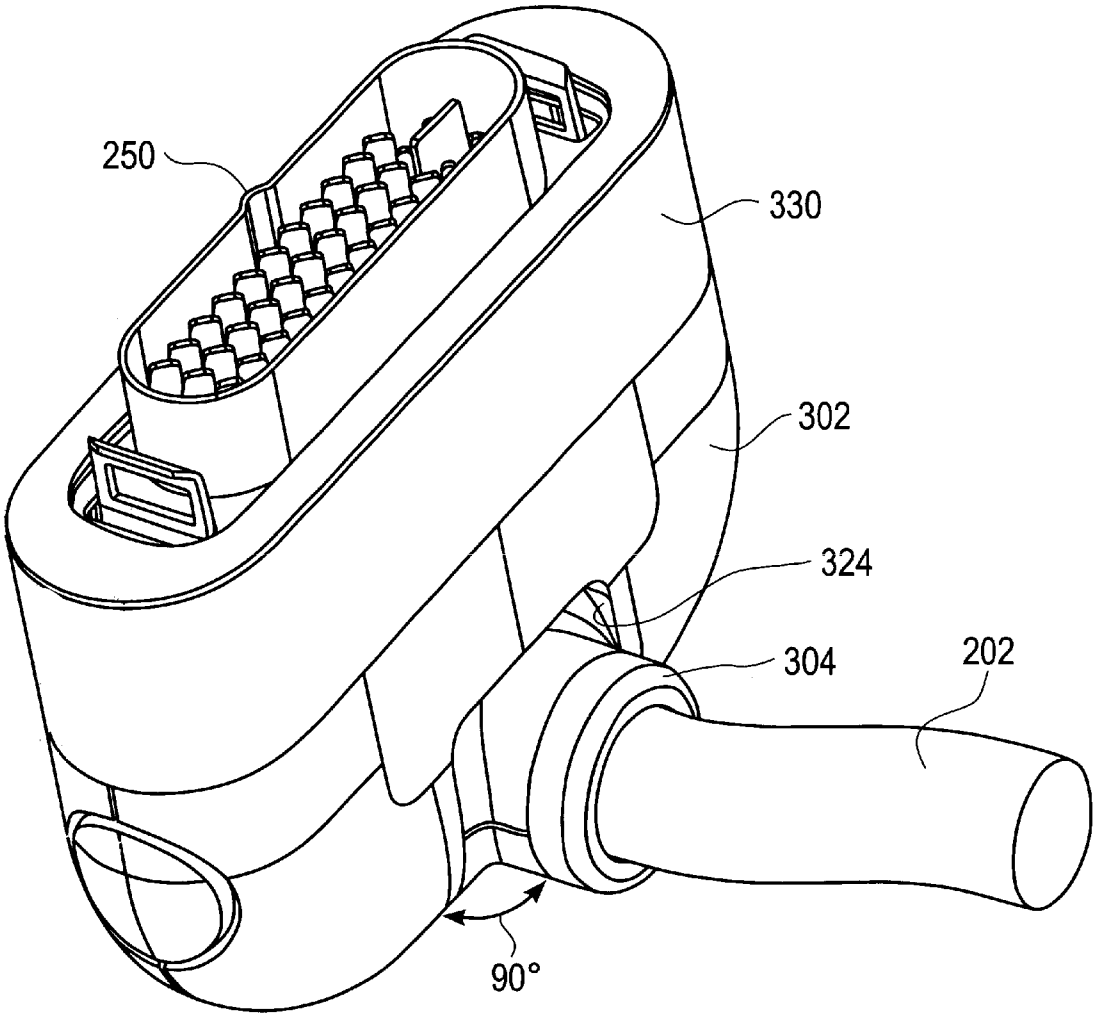
FIG. 4D illustrates an example a main shell at ninety-degree angle orientation to a cable shell which may be an orientation suitable in a connection environment having sufficient space for this orientation.

FIGS. 4C displays main shell 302 at a one hundred eighty-degree orientation to cable shell 304. Such an orientation may be sufficient to employ in personal computer system 100 of FIG. 1B. FIG. 4D displays main shell 302 at a ninety-degree orientation to cable shell 304. Such an orientation may be sufficient to employ in personal computer system 150 of FIG. 1A.

Cable shell 304 may be made from any thermoplastic that presents a high-impact strength, such as a polycarbonate. Main shell 302 may be made of any material that is different or dissimilar from cable shell 304 to minimize or prevent galling. Galling is a process where similar material rubbing surfaces are damaged by friction and abrasion. In one embodiment, main shell 302 includes acrylonitrile butadiene styrene (ABS), such as in polycarbonate ABS (PC/ABS). Where first main shell piece 352 is ultrasonically welded to second main shell piece 354, cable shell 304 may be made of a material that resists the heat of this ultrasonic welding process.

To assemble cable assembly 200 into housing 300, FIGS. 5–6 illustrate that cable 202 may be disposed through second cavity 306 and first cavity 320. Once cable 202 is disposed in side cavity 320, connector 204 may then be attached to cable 202 as shown in FIGS. 2A–B. An electromagnetic interference (EMI) shield 224 may be disposed over the connector 204 to prevent electromagnetic interference caused by the wires 206 inside the cable 202 as discussed above in relation to FIGS. 2A–B. Due to the movement of cable 202 with respect to connector 204, a rigid EMI shield 224 may cause damage to wires 206. In one embodiment, a flexible EMI shield 224 may be disposed at the juncture between wires 206 and posts 212 so as to act as a strain relief that relieves axial stress. Flexible EMI shield 224 may be disposed within adhesives, such as paste, mucilage, glue, or epoxy.

Figure 7:
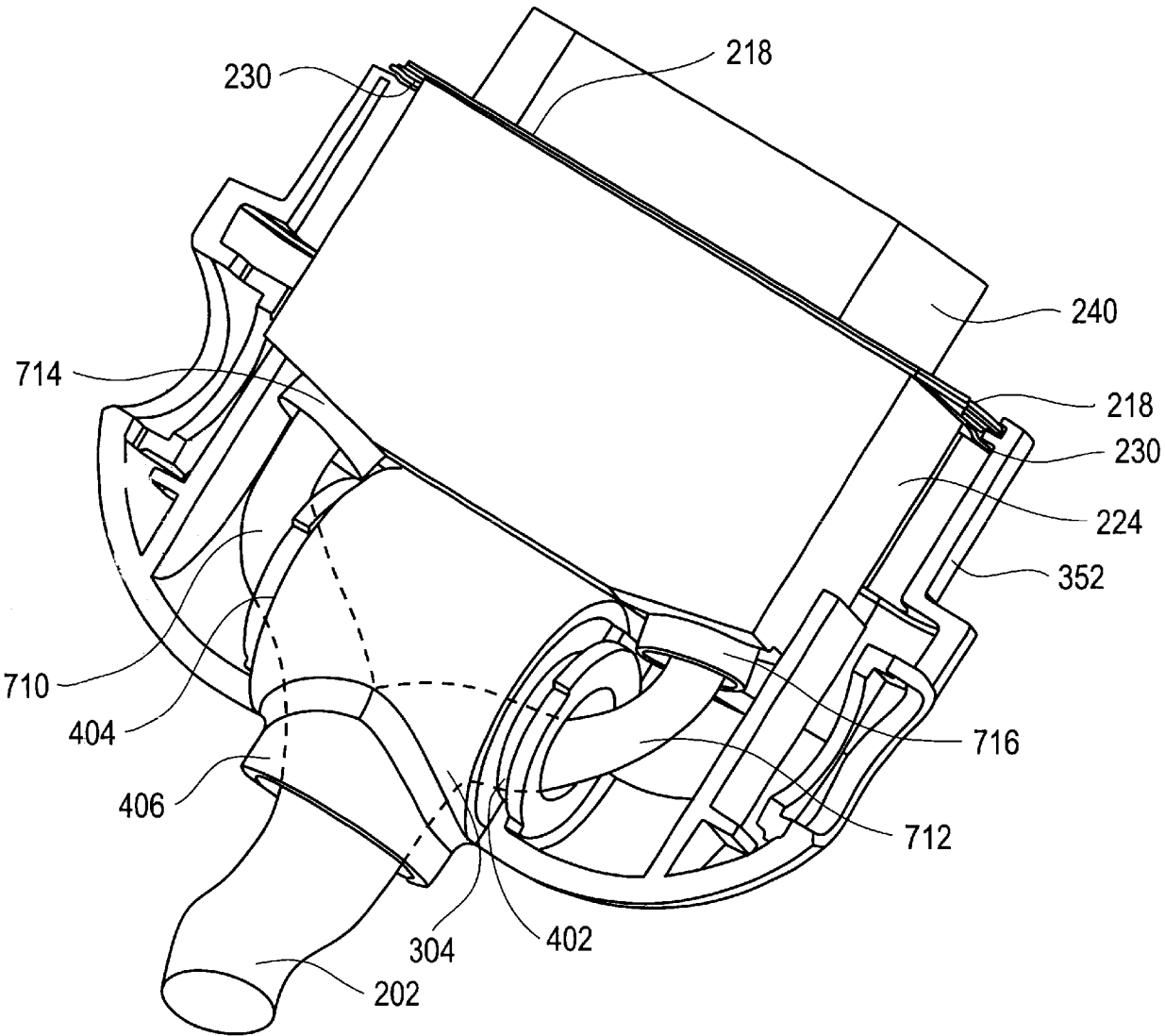
FIG. 7 illustrates an example of splitting cable within an assembly.
Figure 9:
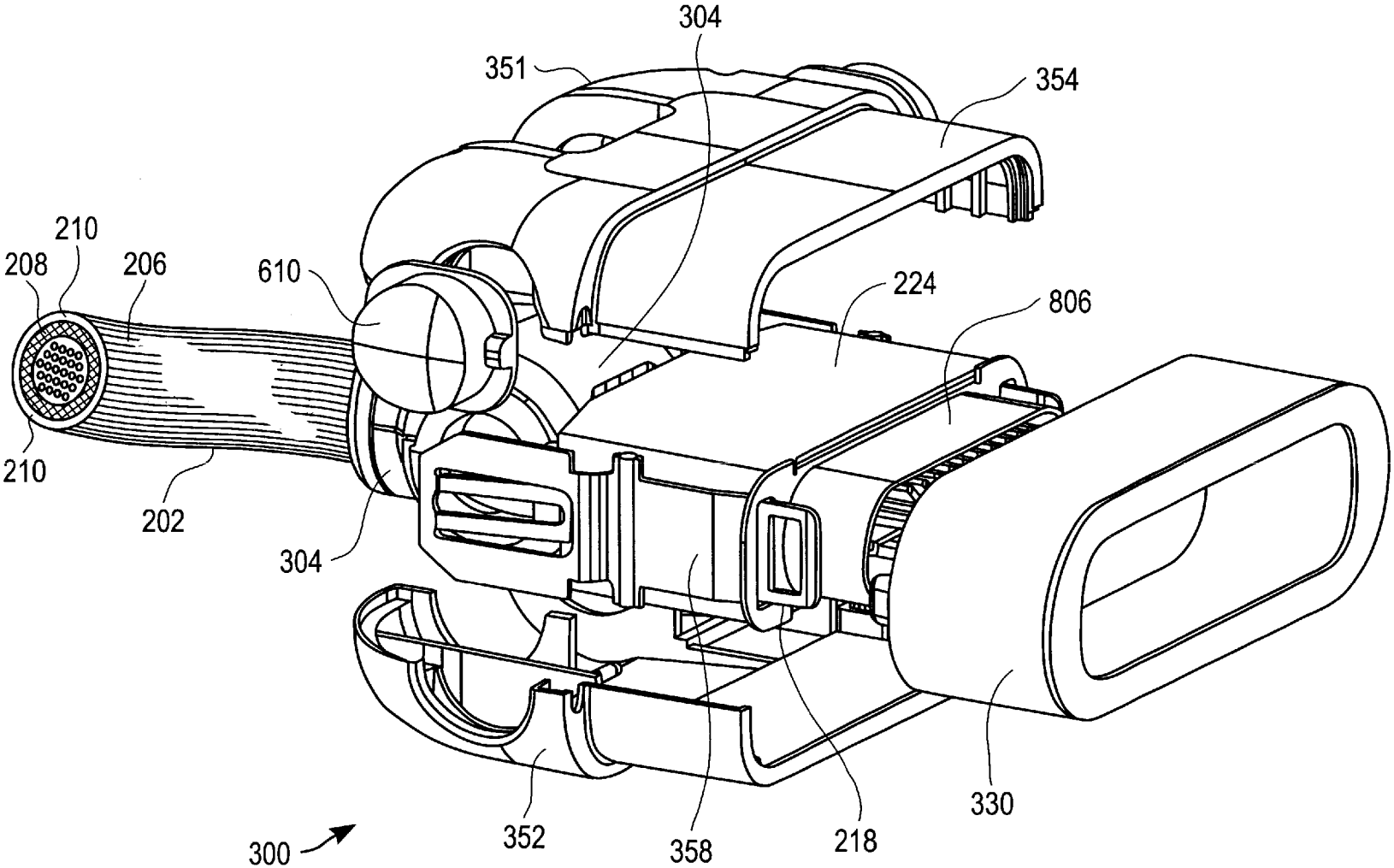
FIG. 9 illustrates an example of assembling a cable assembly according to an embodiment of the invention.

FIG. 7 illustrates that one unique feature about the cable assembly according to this invention is the splitting of the bundle of wires into two bundles.

Generally, according to this invention, cable wires enter into the housing in a single bundle of wires and are then split into two bundles of wires. Each bundle of wires is then routed into two separate paths through each side of the connection path between the connector portion and cable shell portion. Splitting the bundle of cable wires into two bundles may avoid having to bend a full thickness of cable wires. This is a significant advantage in a compact connector that has reduced space requirements and hence making accommodating the bending of large cable difficult. Bending two separate smaller bundles facilitates the making of the overall connector portion length compact.

As depicted in FIG. 7, in one embodiment, cable 202, having a plurality of wires, enters neck 406 of cable shell 304 as one bundle. Once inside cable shell 304, cable 202 is divided into two bundles of wires, 710 and 712. Each of bundles 710 and 712 is then routed through either neck 402 or 404. In this embodiment, it is preferred that cable shell 304 be made out of a top cable shell piece 418 and a bottom cable shell piece 420 describe above in FIG. 4A for ease of splitting the wires. In that instance, wires 206 would be placed on a bottom cable shell piece 420 and then be split into bundles 710 and 712. Follow that, top cable shell piece 418 may then be brought into contact with the bottom cable shell piece 420 thereby forming cable shell 304 in which, bundles 710 and 712 are inserted.

Once divided, wires 206 are no longer covered by a jacket 210 or shield 208 and may be prone to cause electromagnetic interference. It is thus desirable to insulate bundles 710 and 712 with flexible EMI shield (not shown) to prevent electromagnetic interference. This flexible shield may be a soft copper sheet or a flexible conductive shrink tube wrapping around bundles 710 and 712. This flexible shield Wires in each of bundles 710 and 712 may then be connected to posts 212 shown in FIGS. 2A–B.

In one embodiment, EMI shield 224 includes two back openings 714 and 716. (See FIG. 7). Each of bundles 710 and 712 may be inserted through either back openings 714 or 716 and be disposed through EMI shield 224.

EMI shield 224 may include a top shield piece 802 coupled to a bottom shield piece 804 (See FIG. 8-1 and 8-2). EMI shield 224 may couple to connector shell 806. Connector shell 806 would replace shell 220 of FIG. 2A or shell 240 of FIG. 2B.

One advantage of splitting cable wires 206 according to this invention is that more wires can be inserted into connector 204. According to this invention, it may be advantageous to include more than one type of cable wires in cable assembly 300. For instance, a connector 204 may include both power signals and video signals for connecting a monitor to a CPU (Central Processing Unit). In such case, it may be important to differentiate between the traditional Plug and Display connector 200 shown in FIG. 2A from the improved connector 201 shown in FIG. 2B. Mixing up the improved connector 201 with the traditional Plug and Display connector 200 could potentially result in applying power to the wrong pins 212 thus, causing damages to the unit being connected to. To achieve this purpose, shell 806 of the improved connector 201 may have a different shape as compared to the traditional plug and display connector 200.

In one embodiment, connector shell 806 has a "racetrack" or a lozenge" shape which is essentially oval or oblong. (See FIGS. 2, 4C and 4D). It may be desirable, according to this invention, to include a notch 250 on one side of connector shell 806 to facilitate in direction of insertion. Notch 250 may act as a key located on one side of shell 806 to provide orientation and insertion guidance for connector 204.

In one embodiment, cable assembly 300 may also include two quicklatches 358 as illustrated in FIG. 6. Each of quicklatches 358 may extend from connector shell 806 to the distal end portion of main shell 302. Alternatively, each quicklatches 358 may have a length that may be defined by a distance between connector shell 806 and cable shell 304. Cable assembly 300 may further include flange 218 having two slits 230 (slits illustrated in FIG. 2A-B). One quicklatch 358 may be inserted through one of slits 230 and the other quicklatch 358, through the other slit 230. Once assembled, these two quicklatches 358 may latch onto a structure. In this way, the traditional screwing mechanism needed to keep a connector in good contact with a structure is replaced by the latching mechanism of quicklatches 358.

Preferably, cable assembly 300 should include two buttons 610 as illustrated in FIG. 6. Buttons 610 may be partially embedded, one on each side, of main shell 302. Buttons 610 functions as releasing mechanism whereby when buttons 610 are depressed, quicklatches 358 may move to release or detach connector 204 of cable assembly 300 from a structure.

For economic and other reasons, it may be desirable to be able to use the same cable assembly design for both the desktop configuration as shown in FIG. 2A and the stand alone configuration as shown in FIG. 2B. Accordingly, it may be desirable to have a cable assembly where the connector is rotatable about an axis of the cable.

The exemplary embodiments described herein are provided merely to illustrate the principles of the invention and should not be construed as limiting the scope of the subject matter of the terms of the claimed invention. The specification and drawings are, accordingly, to be regarded in an illustrative rather than a restrictive sense. Moreover, the principles of the invention may be applied to achieve the advantages described herein and to achieve other advantages or to satisfy other objectives, as well.

We claim:

1. A cable assembly housing comprising: a main shell that defines a first cavity, said main shell having a collar; a cable shell that defines a second cavity, said cable shell having a first neck, a second neck and a third neck, said first neck, said second neck are disposed through said collar and inside said first cavity, and said third neck extending outside said collar, wherein said first neck is disposed between a first mating surface and a first flange, wherein said second neck disposed between a second mating surface and a second flange, and wherein said first flange and said second flange are disposed through said collar, and inside said first cavity.

2. A cable assembly housing as in claim 1 wherein each mating surface defines a first perimeter and wherein each said first perimeter is circular, and wherein each said neck defines a second perimeter and wherein each said second perimeter is circular.

3. A cable assembly housing as in claim 2 wherein said cable shell includes a top cable shell piece coupled to a bottom cable shell piece.

4. A cable assembly housing as in claim 3 wherein said main shell includes:

a first main shell piece having a first orifice coupling to a second main shell piece having a second orifice, said coupling forming said collar and said main shell; and a crystal cap disposed about said main shell, said crystal cap to secure said coupling between said first main shell piece and said second main shell piece.

5. A cable assembly housing as in claim 4 wherein said first orifice comprises a first edge and a second edge running parallel to a third edge, and wherein said second orifice comprises a fourth edge and a fifth edge running parallel to a sixth edge.

6. A cable assembly housing as in claim 5 further comprising:

a first boss coupled to said second edge;

a second boss coupled to said third edge;

a third boss coupled to said fifth edge;

a fourth boss coupled to said sixth edge; and said first neck disposed between said first boss and said fourth boss, and said second neck disposed between said second boss and said third boss.

7. A cable assembly housing as in claim 6 wherein said first neck and said second neck rotate inside and about an axis of said main shell, and said cable shell to rotate about said main shell.

8. A cable assembly housing as in claim 7 further comprising:

at least one slot defined into an outer surface of said cable shell and extending axially along said outer surface;

at least one detent coupling to said first main shell piece, said detent to engage said slot to lock said cable shell into a predetermined angle and position with respect to said main shell.

9. A cable assembly housing as in claim 8 wherein said predetermined angle and position is ninety degrees.

10. A cable assembly housing as in claim 8 wherein said predetermined angle and position is one-eighty degrees.

11. A cable assembly housing as in claim 8 wherein said at least one slot is two slots, wherein each slot is orientated at a ninety degree angle to the other slot, and wherein said detent only engages into one of said two slots at one time.

12. A cable assembly comprising:

a cable having a plurality of wires disposed within a shell, wherein said shield is disposed within a jacket;

a connector having a plurality of posts coupled to a cover, said connector further having a connector shell disposed about said posts, wherein each wire is coupled a post to form a juncture;

an electromagnetic interference shield disposed over said cover and over each said juncture;

a main shell that defines a first cavity, said main shell having a collar, wherein said connector is disposed in said first cavity and said cable is disposed through said collar; and a cable shell that defines a second cavity, said cable shell having a first neck, a second neck and a third neck, said first neck and said second neck are disposed through the collar and inside said first cavity, said third neck extending outside said collar and wherein said cable is disposed through said second cavity wherein said first neck is disposed between a first mating surface and a first flange;

said second neck is disposed between a second mating surface and a second flange; and said first flange and said second flange are disposed through said collar and inside said first cavity.

13. A cable assembly as in claim 12 wherein each mating surface defines a first perimeter, wherein each said first perimeter is circular, and wherein each neck defines a second perimeter and wherein each said second perimeter is circular.

14. A cable assembly as in claim 13 wherein said main shell includes a first main shell piece having a first orifice;

a second main shell piece having a second orifice, said first main shell piece coupling to said second main shell piece joining said first orifice to said second orifice forming said collar and said main shell; and a crystal cap disposed about said main shell, said crystal cap to secure said coupling between said first main shell piece and said second main shell piece.

15. A cable assembly as in claim 14 wherein said cable shell includes a top cable shell piece coupled to a bottom cable shell piece.

16. A cable assembly as in claim 15 wherein said first neck and said second neck rotate about an axis of said main shell to allow said cable shell to rotate about said main shell.

17. A cable assembly as in claim 16 further comprising:

at least one slot defined into an outer surface of said cable shell and extending axially along said outer surface;

at least one detent coupling to said first main shell piece, said detent to engage said slot to lock said cable shell into a predetermined angle and position with respect to said main shell.

18. A cable assembly as in claim 17 wherein said predetermined angle and position is ninety degrees.

19. A cable assembly as in claim 17 wherein said predetermined angle and position is one-eighty degrees.

20. A cable assembly as in claim 17 wherein said at least one slot is two slots, wherein each one of said two slots is orientated at a ninety degree angle to the other slot, and wherein said detent only engages into one of said two slots at one time.

21. A cable assembly as in claim 20 wherein said wires are divided into a first bundle and a second bundle, said first bundle of wires disposed through said first neck and said second bundle disposed through said second neck; and wherein said cable shell further comprising a second flexible electromagnetic interference shield to wrap around said first and second bundles.

22. A cable assembly as in claim 21 wherein said electromagnetic interference shield can includes two back openings each said back openings to receive one of said first and said second bundles and a front can opening to dispose over and between each said juncture and said cover.

23. A cable assembly as in claim 22 wherein said connector shell has a racetrack shape and includes a key on one side of said connector shell to provide orientation and insertion guidance for said connector.

24. A cable assembly as in claim 23 further comprising a flange disposed between said cover and said plurality of posts, said flange having a first slit and a second slit;

two quicklatches having a length defined by a distance between said connector shell and said cable shell, one of said two quicklatches is disposed through said first slit and the remain of said two quicklatches is disposed through said second slit, said two quicklatches to secure said connector to a structure.

25. A cable assembly as in claim 24 wherein said main shell includes two buttons partially disposing on the inside of said main shell and partially extending on an outer surface of said main shell, each of said two buttons to contact one of said two quicklatches inside said main shell so as to facilitate releasing of said connector from a structure.

* * * * *